US009598751B2

(12) United States Patent
Masuda et al.

(10) Patent No.: US 9,598,751 B2
(45) Date of Patent: Mar. 21, 2017

(54) HIGH STRENGTH COLD-ROLLED STEEL SHEET EXHIBITING LITTLE VARIATION IN STRENGTH AND DUCTILITY, AND MANUFACTURING METHOD FOR SAME

(71) Applicant: Kobe Steel, Ltd., Kobe-shi (JP)

(72) Inventors: Tomokazu Masuda, Kobe (JP); Katsura Kajihara, Kobe (JP); Toshio Murakami, Kobe (JP); Masaaki Miura, Kakogawa (JP); Muneaki Ikeda, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 262 days.

(21) Appl. No.: 14/400,432

(22) PCT Filed: May 24, 2013

(86) PCT No.: PCT/JP2013/064536
§ 371 (c)(1),
(2) Date: Nov. 11, 2014

(87) PCT Pub. No.: WO2013/180037
PCT Pub. Date: Dec. 5, 2013

(65) Prior Publication Data

US 2015/0114524 A1 Apr. 30, 2015

(30) Foreign Application Priority Data

May 29, 2012 (JP) ..... 2012-122033

(51) Int. Cl.
*C22C 38/00* (2006.01)
*C21D 9/46* (2006.01)
(Continued)

(52) U.S. Cl.
CPC ..... *C22C 38/38* (2013.01); *C21D 1/26* (2013.01); *C21D 6/005* (2013.01); *C21D 8/0236* (2013.01);
(Continued)

(58) Field of Classification Search
CPC ..... C21D 2211/002; C21D 2211/003; C21D 2211/004; C21D 2211/005;
(Continued)

(56) References Cited

U.S. PATENT DOCUMENTS 8,343,288 B2 1/2013 Murakami et al.
8,679,265 B2 3/2014 Murakami et al.
(Continued)

FOREIGN PATENT DOCUMENTS

JP 2000 212684 8/2000
JP 2003 277832 10/2003
(Continued)

OTHER PUBLICATIONS

U.S. Appl. No. 14/400,453, filed Nov. 11, 2014, Masuda, et al.
(Continued)

*Primary Examiner* — Scott Kastler
*Assistant Examiner* — Vanessa Luk
(74) *Attorney, Agent, or Firm* — Oblon, McClelland, Maier & Neustadt, L.L.P.

(57) ABSTRACT

In a high strength cold-rolled steel plate having a specific chemical composition, a soft first phase (ferrite) has an area ratio of 20-50%, the remainder being a hard second phase (tempered martensite and/or tempered bainite), among all the ferrite grains, ferrite grains that have an average grain diameter of 10-25 μm account for a total area ratio of 80% or more, the number of the cementite grains that have an equivalent circle diameter of 0.3 μm or more is more than
(Continued)

0.15 piece and 1.0 piece or less per 1 $\mu m^2$ of ferrite, and the tensile strength is 980 MPa or more.

17 Claims, 1 Drawing Sheet

(51) Int. Cl.

| | |
|---|---|
| ***C22C 38/38*** | (2006.01) |
| ***C22C 38/06*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |
| ***C22C 38/22*** | (2006.01) |
| ***C21D 6/00*** | (2006.01) |
| ***C21D 8/02*** | (2006.01) |
| ***C21D 1/26*** | (2006.01) |

(52) U.S. Cl.
CPC ..... *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C22C 38/22* (2013.01)

(58) Field of Classification Search
CPC ..... C21D 2211/008; C21D 1/26; C21D 1/28; C21D 1/30; C21D 1/32; C21F 9/46
See application file for complete search history.

(56) References Cited

U.S. PATENT DOCUMENTS

| | | | | |
|---|---|---|---|---|
| 8,840,738 | B2 | 9/2014 | Murakami et al. | |
| 8,951,366 | B2 * | 2/2015 | Sano | C21D 8/0436 148/320 |
| 2004/0238082 | A1 * | 12/2004 | Hasegawa | C22C 38/02 148/652 |
| 2009/0056836 | A1 * | 3/2009 | Watanabe | C21D 9/46 148/333 |
| 2009/0277547 | A1 | 11/2009 | Saito et al. | |
| 2010/0252147 | A1 | 10/2010 | Murakami et al. | |
| 2010/0330392 | A1 * | 12/2010 | Ono | C21D 8/0247 428/659 |
| 2013/0037180 | A1 * | 2/2013 | Sano | C21D 8/0436 148/603 |
| 2014/0305553 | A1 | 10/2014 | Masuda et al. | |

FOREIGN PATENT DOCUMENTS

| | | |
|---|---|---|
| JP | 2007 138262 | 6/2007 |
| JP | 2009 144239 | 7/2009 |
| JP | 2010 255050 | 11/2010 |
| JP | 2011 38121 | 2/2011 |
| JP | 2011 80106 | 4/2011 |
| JP | 2013 124400 | 6/2013 |

OTHER PUBLICATIONS

International Search Report and Written Opinion of the International Searching Authority Issued Aug. 13, 2013 in PCT/JP13/064536 Filed May 24, 2013.

* cited by examiner

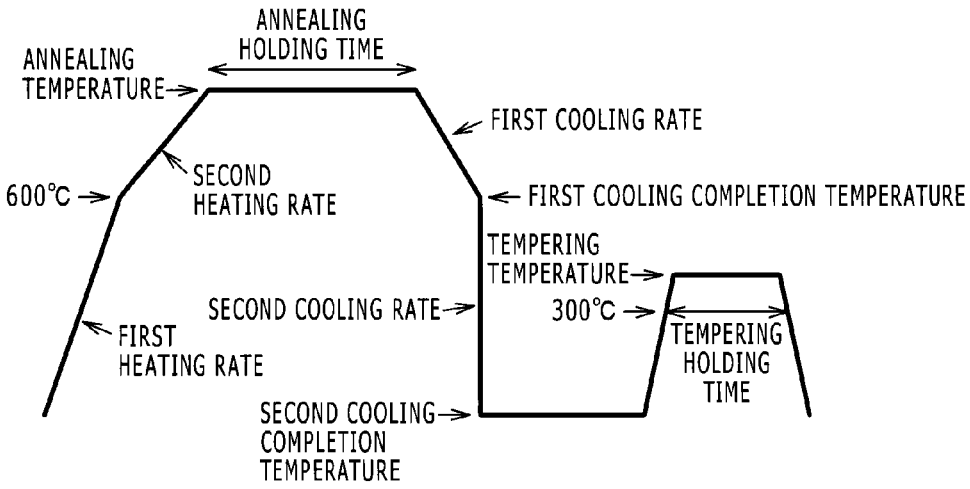
ANNEALING HOLDING TIME
ANNEALING TEMPERATURE
FIRST COOLING RATE
SECOND HEATING RATE
600°C
FIRST COOLING COMPLETION TEMPERATURE
TEMPERING TEMPERATURE
SECOND COOLING RATE
300°C
FIRST HEATING RATE
TEMPERING HOLDING TIME
SECOND COOLING COMPLETION TEMPERATURE

HIGH STRENGTH COLD-ROLLED STEEL SHEET EXHIBITING LITTLE VARIATION IN STRENGTH AND DUCTILITY, AND MANUFACTURING METHOD FOR SAME

TECHNICAL FIELD

The invention of the present application relates to a high strength cold-rolled steel sheet excellent in workability used for automobile components and the like, and a manufacturing method for the same.

BACKGROUND ART

In recent years, in order to achieve both of fuel economy improvement and collision safety of an automobile, there is a growing need for a high strength steel sheet of 590 MPa or more tensile strength as a material for structural components, and the application range thereof is widening. However, because the variation in the mechanical property such as the yield strength, tensile strength, work hardening index, and the like of the high strength steel sheet is large compared to that of a mild steel, there are problems that the dimensional accuracy of the press formed product is hardly secured because the spring-back quantity changes in press forming, and that the life of the press forming tool is shortened because the average strength of the steel sheet should be set high in order to secure the required strength of the press formed product even when the strength disperses.

In order to solve such problems, various trials have been made with respect to suppressing the variation in the mechanical property in the high strength steel sheet. The cause of generation of the variation in the mechanical property as described above in the high strength steel sheet can be attributed to the fluctuation in the chemical composition and the variation of the manufacturing condition, and following proposals have been made with respect to methods for reducing the variation in the mechanical property.

PRIOR ART 1

For example, in Patent Literature 1, a method for reducing the variation in the mechanical property is disclosed in which the steel sheet is made a dual-phase microstructure steel having ferrite and martensite in which A defined by $A=Si+9\times Al$ satisfies $6.0\leq A\leq 20.0$, in manufacturing the steel sheet, recrystallization annealing/tempering treatment is executed by holding at a temperature of Ac1 or above and Ac3 or below for 10 s or more, slow cooling at a cooling rate of 20° C./s or less for 500-750° C., rapid cooling thereafter at a cooling rate of 100° C./s or more to 100° C. or below, and tempering at 300-500° C., thereby Ac3 point of the steel is raised, and thereby the stability of the dual-phase microstructure when the rapid cooling start temperature that is the temperature of the slow cooling completion time point fluctuates is improved.

PRIOR ART 2

Also, in Patent Literature 2, a method is disclosed in which the variation in the strength is reduced by that the relation between the tensile strength and the sheet thickness, carbon content, phosphorus content, quenching start temperature, quenching stop temperature, and tempering temperature after quenching of the steel sheet is obtained beforehand, the quenching start temperature is calculated according to the target tensile strength considering the sheet thickness, carbon content, phosphorus content, quenching stop temperature, and tempering temperature after quenching of the steel sheet of the object, and quenching is executed with the quenching start temperature obtained.

PRIOR ART 3

Also, in Patent Literature 3, there is disclosed a method for improving the variation in the elongation property in the sheet width direction by soaking at over 800° C. and below Ac3 point for 30 s-5 min, thereafter executing the primary cooling to the temperature range of 450-550° C., then executing secondary cooling to 450-400° C. with a lower cooling rate than the primary cooling rate, and holding thereafter at 450-400° C. for 1 min or more in the annealing treatment after cold-rolling the hot-rolled steel sheet in manufacturing a steel sheet having the microstructure including 3% or more of the retained austenite.

The prior art 1 described above is characterized to suppress a change in the microstructure fraction caused by the fluctuation in the annealing temperature by increasing the addition amount of Al and raising Ac3 point, thereby expanding the dual-phase temperature range of Ac1-Ac3, and reducing the temperature dependability within the dual-phase temperature range. On the other hand, the invention of the present application is characterized to suppress the fluctuation in the mechanical property caused by the change in the microstructure fraction by positively dispersing coarse cementite grains into the ferrite grain, thereby increasing the hardness of ferrite, reducing C content of the hard second phase to lower the hardness thereof, and thereby reducing the difference in hardness among respective microstructures. Accordingly, the prior art 1 described above does not suggest the technical thought of the invention of the present application. Also, because the prior art 1 described above requires to increase the addition amount of Al, there is also a problem of an increase in the manufacturing cost of the steel sheet.

Further, according to the prior art 2 described above, the quenching temperature is changed according to the change in the chemical composition, therefore the variation in the strength can be reduced, however the microstructure fraction fluctuates among the coils, and therefore the variation in elongation and stretch flange formability cannot be reduced.

Furthermore, although the prior art 3 described above suggests reduction of the variation in elongation, reduction of the variation in stretch flange formability is not suggested.

Therefore, the present inventors advanced the research and development with the aim of providing a high strength cold-rolled steel sheet exhibiting less variation in the mechanical property (particularly the strength and ductility) without increasing the manufacturing cost caused by adjustment of the chemical composition and without being affected by fluctuation in the annealing condition and the manufacturing method for the same, developed the high strength cold-rolled steel sheet and the manufacturing method for the same described below (hereinafter referred to as "preceding inventive steel sheet" and "preceding inventive method" respectively), and already applied for the patent (Japanese Patent Application No. 2011-274269).

The preceding inventive steel sheet includes, in mass %, C: 0.05-0.30%, Si: 3.0% or less (exclusive of 0%), Mn: 0.1-5.0%, P: 0.1% or less (exclusive of 0%), S: 0.02% or less (exclusive of 0%), Al: 0.01-1.0%, and N: 0.01% or less (exclusive of 0%) respectively, with the remainder consisting of iron and inevitable impurities, in which a microstructure includes ferrite that is a soft first phase by 20-50% in terms of area ratio, with the remainder consisting of tempered martensite and/or tempered bainite that is a hard second phase, the dispersion state of cementite grains that have an equivalent circular diameter of 0.3 μm or more present in grains of the ferrite is 0.05-0.15 piece per 1 $\mu m^2$ of the ferrite.

Also, the preceding inventive method includes the steps of hot-rolling, thereafter cold-rolling, thereafter annealing, and tempering a steel having the chemical composition described above with respective conditions shown in (1)-(4) below.

(1) Hot-rolling Condition

Finish-rolling temperature: Ar3 point or above

Coiling temperature: 450° C. or above and below 600° C.

(2) Cold-rolling Condition

Cold-rolling ratio: 20-50%

(3) Annealing Condition

Raising the temperature with a first heating rate of 0.5-5.0° C./s for the temperature range of room temperature-600° C. and with a second heating rate of 1/2 or less of the first heating rate for the temperature range of 600° C.-annealing temperature respectively, holding for annealing holding time of 3,600 s or less at the annealing temperature of (Ac1+Ac3)/2−Ac3, thereafter slow cooling with a first cooling rate of 1° C./s or more and less than 50° C./s from the annealing temperature to a first cooling completion temperature of 730° C. or below and 500° C. or above, and thereafter rapid cooling with a second cooling rate of 50° C./s or more to a second cooling completion temperature of Ms point or below.

(4) Tempering Condition

Tempering temperature: 300-500° C.

Tempering holding time: 60-1,200 s within the temperature range of 300° C.-tempering temperature Although the preceding inventive steel sheet and the preceding inventive method were the technologies useful in suppressing the variation in the mechanical property accompanying the change in the microstructure fraction caused by the fluctuation in the annealing condition by reducing the difference of the hardness between ferrite and tempered martensite, on the other hand, such a technical problem remained that the mechanical property was liable to fluctuate when the chemical composition fluctuated.

The reason the mechanical property is liable to fluctuate when the chemical composition fluctuates is that, when the chemical composition fluctuates, the dual-phase range temperature range changes in particular, the size of the ferrite grains is liable to change, the number of the cementite grains present within the ferrite grain is not so much, therefore the number of the ferrite grains not containing the cementite grain is liable to change, which results that uniformity of the microstructure cannot be maintained, and the mechanical property becomes liable to fluctuate.

CITATION LIST

Patent Literature

[Patent Literature 1] JP-A 2007-138262
[Patent Literature 2] JP-A 2003-277832
[Patent Literature 3] JP-A 2000-212684

SUMMARY OF INVENTION

Technical Problems

Therefore, the object of the invention of the present application is to provide a high strength cold-rolled steel sheet not affected by the fluctuation of the chemical composition and exhibiting less variation in the mechanical property (particularly the strength and ductility), and a manufacturing method for the same.

Solution to Problems

The invention described in claim 1 is a high strength cold-rolled steel sheet exhibiting little variation in strength and ductility including:

C: 0.10-0.25% (means mass %, hereinafter the same with respect to the chemical composition);

Si: 0.5-2.0%;

Mn: 1.0-3.0%;

P: 0.1% or less (exclusive of 0%);

S: 0.01% or less (exclusive of 0%);

Al: 0.01-0.05%; and

N: 0.01% or less (exclusive of 0%) respectively, with the remainder consisting of iron and inevitable impurities; in which a microstructure includes ferrite that is a soft first phase by 20-50% in terms of area ratio, with the remainder consisting of tempered martensite and/or tempered bainite that is a hard second phase;

among grains of the ferrite, a total area of grains that have an average grain size of 10-25 μm accounts for 80% or more of a total area of all grains of the ferrite;

the dispersion state of cementite grains that have an equivalent circle diameter of 0.3 μm or more present in all grains of the ferrite is more than 0.15 piece and 1.0 piece or less per 1 $\mu m^2$ of the ferrite; and the tensile strength is 980 MPa or more.

The invention described in claim 2 is the high strength cold-rolled steel sheet exhibiting little variation in strength and ductility according to claim 1 further including at least one group out of groups of (A)-(C) below.

(A) Cr: 0.01-1.0%

(B) At least one element out of Mo: 0.01-1.0%, Cu: 0.05-1.0%, and Ni: 0.05-1.0%

(C) At least one element out of Ca: 0.0001-0.01%, Mg: 0.0001-0.01%, Li: 0.0001-0.01%, and REM: 0.0001-0.01%

The invention described in claim 3 is a method for manufacturing a high strength cold-rolled steel sheet exhibiting little variation in strength and ductility comprising the steps of hot-rolling, thereafter cold-rolling, thereafter annealing, and tempering a steel having the chemical composition shown in claim 1 or 2 with respective conditions shown in (1)-(4) below.

(1) Hot-rolling Condition

Finish-rolling temperature: Ar3 point or above

Coiling temperature: 600-750° C.

(2) Cold-rolling Condition

Cold-rolling ratio: more than 50% and 80% or less (3) Annealing Condition

Raising the temperature with a first heating rate of 0.5-5.0° C./s for the temperature range of room temperature-600° C. and with a second heating rate of 1/2 or less of the first heating rate for the temperature range of 600° C.-annealing temperature respectively, holding for annealing holding time of 3,600 s or less at the annealing temperature of (Ac1+Ac3)/2−Ac3, thereafter slow cooling with a first cooling rate of 1° C./s or more and less than 50° C./s from the annealing temperature to a first cooling completion temperature of 730° C. or below and 500° C. or above, and thereafter rapid cooling with a second cooling rate of 50° C./s or more to a second cooling completion temperature of Ms point or below.

(4) Tempering Condition

Tempering temperature: 300-500° C.

Tempering holding time: 60-1,200 s within the temperature range of 300° C.-tempering temperature

Advantageous Effects of Invention

According to the invention of the present application, by equalizing the size of the ferrite grains in the dual-phase microstructure steel formed of ferrite that is the soft first phase and tempered martensite and/or tempered bainite that is the hard second phase and increasing the number of the cementite grains present within the ferrite grain, the microstructure containing the cementite grains within almost all ferrite grains is obtained, the microstructure form scarcely changes even when the chemical composition changes, and therefore it has become possible to provide a high strength steel sheet exhibiting little variation in the mechanical property caused by the fluctuation in the chemical composition.

BRIEF DESCRIPTION OF DRAWING

FIG. 1 is a drawing schematically showing a heat treatment pattern of an example.

DESCRIPTION OF EMBODIMENTS

In order to solve the problems described above, the inventors of the present application watched a high strength steel sheet having a dual-phase microstructure formed of ferrite that was the soft first phase and tempered martensite and/or tempered bainite (may be hereinafter collectively referred to as "tempered martensite and the like") that was the hard second phase, and studied the ways and measures for reducing the variation in the mechanical property (may be hereinafter simply referred to as "property") caused by the fluctuation in the chemical composition.

As described above, the variation in the properties by the fluctuation in the chemical composition is caused by that the size of the ferrite grains and the number of the ferrite grains not containing the cementite grain fluctuate by the fluctuation in the chemical composition, and uniformity of the microstructure cannot be maintained as a result.

Therefore, it was considered that the variation in the properties could be suppressed even when the chemical composition fluctuated if the size of the ferrite grains was equalized as much as possible, the cementite grain was contained in each ferrite grain, and the microstructure was made uniform. Further, it was considered that the size of the ferrite grains could be equalized as much as possible and the cementite grain could be contained within each ferrite grain by that the sizes of the ferrite grain remaining from the prior microstructure and the ferrite grain generated in cooling after annealing heating were brought close to each other and that such microstructure as making the cementite grain remain more was formed.

In order to form such microstructure as described above, such a method as described below is possible as an example. In other words, first, by raising the coiling temperature in hot rolling than before, the dual-phase microstructure of ferrite and pearlite is formed. However, when the coiling temperature is raised, the microstructure is coarsened, therefore the cold-rolling ratio in cold rolling of the next step is increased, and a high strain is introduced into the microstructure. Thus, because austenite is easily nucleated in annealing heating of the next step, by being held on the high temperature side of the dual-phase range, more austenite grains are formed, and fine ferrite grains come to remain among these austenite grains. On the other hand, because the size of the ferrite grain nucleated in cooling after annealing heating also becomes generally same to that of the ferrite grain formed in the dual-phase range described above, the size of the ferrite grains in the final microstructure becomes generally uniform as a whole. Also, by annealing heating pearlite to which a strain has been introduced in cold-rolling, pearlite is easily split, and therefore a large number of the cementite grains with equal size come to remain.

Accordingly, although the preceding inventive steel sheet had a microstructure in which the cementite grains were dispersed only within the larger ferrite grains, the steel sheet of the invention of the present application has a microstructure in which the cementite grains are dispersed within almost all ferrite grains.

As a result, in the steel sheet of the invention of the present application, because the microstructure form scarcely changes even when the chemical composition fluctuates within a range specified in the invention of the present application, the variation in the properties comes to be reduced.

Also, as a result of executing a proving test described in [example] below based on the thought experiment described above, a confirmatory evidence was obtained, therefore further studies were made, and the invention of the present application came to be completed.

First, the microstructure characterizing the steel sheet of the invention of the present application will be described below.

[Microstructure of Inventive Steel Sheet]

Although the inventive steel sheet is based on the dual-phase microstructure formed of ferrite that is the soft first phase and tempered martensite and the like that is the hard second phase as described above, it is characterized in the point that the rate of the ferrite grains of a specific size with respect to all ferrite grains and the existence density of the cementite grains of a specific size within all ferrite grains are controlled in particular.

<Ferrite that is Soft First Phase: 20-50% in Terms of Area Ratio>

In the dual-phase microstructure steel such as ferrite-tempered martensite and the like, deformation is handled mainly by ferrite that has high deformability. Therefore, the elongation of the dual-phase microstructure steel such as ferrite-tempered martensite and the like is determined mainly by the area ratio of ferrite.

In order to secure the target elongation, the area ratio of ferrite should be 20% or more (preferably 25% or more, and more preferably 30% or more). However, when ferrite becomes excessive, the strength cannot be secured, and therefore the area ratio of ferrite is made 50% or less (preferably 45% or less, and more preferably 40% or less).

<Total Area of Grains that have Average Grain Size of 10-25 μm among all Grains of the Ferrite: 80% or more of Total Area of all Grains of the Ferrite>

In order to make the microstructure uniform so as not to be affected by the fluctuation in the chemical composition, the size of the ferrite grains should be equalized within a predetermined magnitude range as much as possible.

In order to suppress the variation in the mechanical property caused by the fluctuation in the chemical composition within the determined range of the invention of the present application within a desired range, the total area of the grains that have an average grain size of 10-25 μm among all grains of the ferrite should be made 80% or more (preferably 85% or more) of the total area of all grains of the ferrite.

<Dispersion State of Cementite Grains that have Equivalent Circular Diameter of 0.3 μm or more Present in all Grains of the Ferrite: more than 0.15 Piece and 1.0 Piece or less per 1 $\mu m^2$ of the Ferrite>

In order to make the microstructure more uniform, the cementite grains of a predetermined size should be dispersed within almost all ferrite grains.

In order to suppress the variation in the mechanical property caused by the fluctuation in the chemical composition within the determined range of the invention of the present application within a desired range, the existence density of the cementite grains that have an equivalent circular diameter of 0.3 μm or more should be made more than 0.15 piece (preferably 0.2 piece or more) per 1 $\mu m^2$ of ferrite. However, when the cementite grains with such a size becomes excessive, the ductility deteriorates, and therefore the existence density of the cementite grains described above is limited to 1.0 piece or less (preferably 0.8 piece or less) per 1 $\mu m^2$ of ferrite.

Here, the reason the size of the cementite grains dispersed within the ferrite grain was made 0.3 μm or more was that, by making the cementite grains 0.3 μm or more in terms of the equivalent circular diameter, the degree of contribution to precipitation strengthening by the cementite grains can be reduced, and the variation in the properties caused by the fluctuation in the chemical composition can be reduced.

Below, methods for measuring the area ratio of each phase, the size of the ferrite grain and the area rate of the ferrite grain of a specific size, as well as the size of the cementite grain and the existence density of the cementite grain of a specific size will be described.

[Method for Measuring Area Ratio of Each Phase]

First, with respect to the area ratio of each phase, each specimen steel sheet was mirror-polished and was corroded by a 3% nital solution to expose the metal microstructure, the scanning electron microscope (SEM) image was thereafter observed under 2,000 magnifications with respect to 5 fields of view of approximately 40 μm×30 μm region, 100 points were measured per one field of view by the point counting method, the area of each ferrite grain was obtained, and the area of ferrite was obtained by adding them together. Also, by the image analysis, the region including cementite was defined as tempered martensite and/or tempered bainite (hard second phase), and the remaining region was defined as retained austenite, martensite, and the mixture microstructure of retained austenite and martensite. Further, from the area percentage of each region, the area ratio of each phase was calculated.

[Method for Measuring Size of Ferrite Grain and Area Rate of Ferrite Grain of Specific Size]

By calculating the equivalent circle diameter $D\alpha$ ($D\alpha=2\times(A\alpha/\pi)^{1/2}$) from $A\alpha$ which is the area of each ferrite grain obtained by the method described above, obtaining the total area of the ferrite grains of a specific size, and dividing the same by the total area of all grains of ferrite described above, the area rate of the ferrite grain of a specific size can be obtained.

[Method for Measuring Size of Cementite Grain and Existence Density of Cementite Grain of Specific Size]

With respect to the size of the cementite grain and the existence density of the cementite grain of a specific size, the extracted replica sample of each specimen steel sheet was manufactured, the transmission electron microscope (TEM) image was observed under 50,000 magnifications with respect to 3 fields of view of 2.4 μm×1.6 μm region, white portions were determined to be cementite grains from the contrast of the image and were marked, the equivalent circle diameter $D\theta$ ($D\theta=2\times(A\theta/\pi)^{1/2}$) was calculated from $A\theta$ which was the area of each cementite grain marked described above by an image analysis software, and the number of the cementite grains of a specific size present per unit area was obtained. Also, the portion where plural numbers of the cementite grains overlap was excluded from the observation object.

Next, the chemical composition constituting the steel sheet of the invention of the present application will be described. Below, all units of the chemical composition are mass %.

[Chemical Composition of Invention Steel Sheet]

C: 0.10-0.25%

C is an important element affecting the area ratio of the hard second phase and the amount of cementite present in ferrite, and affecting the strength, elongation and stretch flange formability. When C content is less than 0.10%, the strength cannot be secured. On the other hand, when C content exceeds 0.25%, the weldability deteriorates. The range of C content is preferably 0.12-0.22%, and more preferably 0.14-0.20%.

Si: 0.5-2.0%

Si is a useful element having an effect of suppressing coarsening of the cementite grain in tempering, and contributing to fulfillment of both of elongation and stretch flange formability. When Si content is less than 0.5%, the effects described above cannot be sufficiently exerted, therefore fulfillment of both of elongation and stretch flange formability cannot be achieved, whereas when Si content exceeds 2.0%, formation of austenite in heating is impeded, therefore the area ratio of the hard second phase cannot be secured, and stretch flange formability cannot be secured. The range of Si content is preferably 0.7-1.8%, and more preferably 1.0-1.5%.

Mn: 1.0-3.0%

In addition to having an effect of suppressing coarsening of cementite in tempering similarly to Si described above, Mn contributes to fulfillment of both of elongation and stretch flange formability by increasing formability of the hard second phase. Further, there is also an effect of widening the range of the manufacturing condition for obtaining the hard second phase by enhancing quenchability. When Mn content is less than 1.0%, the effects described above cannot be sufficiently exerted, therefore fulfillment of both of elongation and stretch flange formability cannot be achieved, whereas when Mn content exceeds 3.0%, the reverse transformation temperature becomes excessively low, recrystallization cannot be effected, and therefore the balance of the strength and elongation cannot be secured. The range of Mn content is preferably 1.2-2.5%, and more preferably 1.4-2.2%.

P: 0.1% or less (Exclusive of 0%)

Although P inevitably exists as an impurity element and contributes to increase of the strength by solid solution strengthening, because P deteriorates stretch flange formability by segregating on the prior austenite grain boundary and embrittling the grain boundary, P content is made 0.1% or less, preferably 0.05% or less, and more preferably 0.03% or less.

S: 0.01% or less (Exclusive of 0%)

S also inevitably exists as an impurity element and deteriorates stretch flange formability by forming MnS inclusions and becoming an origin of a crack in enlarging a hole, and therefore S content is made 0.01% or less, preferably 0.008% or less, and more preferably 0.006% or less.

Al: 0.01-0.05%

Al is added as a deoxidizing element, and has an effect of miniaturizing the inclusions. Also, by joining with N to form AlN and reducing solid solution N that contributes to generation of strain aging, Al prevents deterioration of elongation and stretch flange formability. When Al content is less than 0.01%, because solid solution N remains in steel, strain aging occurs, and elongation and stretch flange formability cannot be secured. On the other hand, when Al content exceeds 0.05%, because Al impedes formation of austenite in heating, the area ratio of the hard second phase cannot be secured, and stretch flange formability cannot be secured.

N: 0.01% or less (Exclusive of 0%)

N also inevitably exists as an impurity element and deteriorates elongation and stretch flange formability by strain aging, and therefore N content is preferable to be as less as possible, and is made 0.01% or less.

The steel of the invention of the present application basically contains the composition described above, and the remainder is substantially iron and impurities. However, other than the above, allowable compositions described below can be added within a range not impairing the action of the invention of the present application.

Cr: 0.01-1.0%

Cr is a useful element that can improve stretch flange formability by suppressing growth of cementite. When Cr is added by less than 0.01%, the action as described above cannot be effectively exerted, whereas when Cr is added exceeding 1.0%, coarse $Cr_7C_3$ comes to be formed, and stretch flange formability deteriorates.

At least one element out of

Mo: 0.01-1.0%,

Cu: 0.05-1.0%, and

Ni: 0.05-1.0%

These elements are elements useful in improving the strength without deteriorating formability by solid solution strengthening. When respective elements are added by less than respective lower limit values described above, the action as described above cannot be effectively exerted, whereas when respective elements are added exceeding 1.0%, the cost increases excessively.

At least one element out of

Ca: 0.0001-0.01%,

Mg: 0.0001-0.01%,

Li: 0.0001-0.01%, and

REM: 0.0001-0.01%

These elements are elements useful in improving stretch flange formability by miniaturizing inclusions and reducing an origin of fracture. When respective elements are added by less than 0.0001%, the action as described above cannot be effectively exerted, whereas when respective elements are added exceeding 0.01%, the inclusions are coarsened adversely, and stretch flange formability deteriorates.

Also, REM means rare earth metals which are 3A group elements in the periodic table.

Next, a manufacturing method for obtaining the inventive steel sheet of the present application will be described below.

[Manufacturing Method for Inventive Steel Sheet]

In order to manufacture such a cold-rolled steel sheet as described above, first, steel having the chemical composition as described above is smelted, is made into a slab by blooming or continuous casting, is thereafter hot-rolled, is pickled, and is cold-rolled.

[Hot Rolling Condition]

With respect to the hot rolling condition, it is preferable to set the finish rolling temperature at Ar3 point or above, to execute cooling properly, and to execute coiling thereafter in a range of 600-750° C.

<Coiling Temperature: 600-750° C.>

By making the coiling temperature 600° C. or above (preferably 610° C. or above) which is a temperature higher than that in the preceding inventive method described above, the dual-phase microstructure of ferrite and pearlite is formed. However, when the coiling temperature is made excessively high, cementite in the pearlite portion is spheroidized and initial cementite is liable to become excessively large, and therefore the coiling temperature is made 750° C. or below (preferably 700° C. or below).

[Cold Rolling Condition]

With respect to the cold rolling condition, it is preferable to make the cold rolling ratio in the range of more than 50% and 80% or less.

<Cold Rolling Ratio: more than 50% and 80% or less>

By making the cold rolling ratio more than 50% (preferably 52% or more) which is higher than that in the preceding inventive method described above, a high strain is introduced into the microstructure. However, when the cold rolling ratio is made excessively high, the deformation resistance in cold rolling becomes excessively high, the rolling speed is lowered, thereby the productivity extremely deteriorates, and therefore the cold rolling ratio is made 80% or less (preferably 70% or less).

Also, after the cold rolling, annealing and tempering are executed subsequently.

[Annealing Condition]

With respect to the annealing condition, it is preferable to raise the temperature with the first heating rate of 0.5-5.0° C./s for the temperature range of room temperature-600° C. and with the second heating rate of 1/2 or less of the first heating rate for the temperature range of 600° C.-annealing temperature respectively, to hold for the annealing holding time of 3,600 s or less at the annealing temperature of (Ac1+Ac3)/2−Ac3, to execute slow cooling thereafter with the first cooling rate (slow cooling rate) of 1° C./s or more and less than 50° C./s from the annealing temperature to the first cooling completion temperature (slow cooling completion temperature) of 730° C. or below and 500° C. or above, and to execute rapid cooling thereafter with the second cooling rate (rapid cooling rate) of 50° C./s or more to the second cooling completion temperature (rapid cooling completion temperature) of Ms point or below.

<Raising Temperature with First Heating Rate of 0.5-5.0° C./s for Temperature Range of Room Temperature-600° C.>

The reason for setting the above condition is that, in annealing for the cold-rolled material, first, in the process of recrystallization of ferrite, by heating comparatively slowly, the cementite grains that have been already precipitated in the prior microstructure are to be coarsened, the cementite grains are to be taken in to the recrystallized ferrite, and thereby such microstructure is to be obtained that large cementite grains are present within the ferrite grain. Further, in the heating, the dislocation density in ferrite can also be sufficiently reduced.

In order to exert the actions described above effectively, it is preferable to make the first heating rate 5.0° C./s or less (preferably 4.8° C./s or less). However, when the first heating rate is excessively low, cementite becomes excessively coarse, the ductility is deteriorated, and therefore 0.5° C./s or more is preferable (more preferably 1.0° C./s or more).

<Raising Temperature with Second Heating Rate of 1/2 or less of First Heating Rate for Temperature Range of 600° C.-Annealing Temperature>

The reason for setting the above condition is that, next, a part of cementite coarsened as described above is to be dissolved by heating and holding for a predetermined time at Ac1 point-annealing temperature (dual-phase temperature range), the solid solution C is to be concentrated into ferrite by rapid cooling thereafter to near the room temperature, thereby the difference in the hardness between ferrite and tempered martensite is to be reduced and the variation in the mechanical property caused by the fluctuation in the annealing condition is to be suppressed similarly to the preceding inventive steel sheet.

In order to exert the actions described above effectively, it is preferable to make the second heating rate 1/2 or less (preferably 1/3 or less) of the first heating rate.

<Holding for Annealing Holding Time of 3,600 s or less at Annealing Temperature of (Ac1+Ac3)/2−Ac3>

The reason for setting the above condition is that, by holding on the high temperature side of the dual-phase range, austenite is to be easily nucleated, fine ferrite is made to remain, the region of 50% or more in terms of the area ratio is to be transformed into austenite, and thereby the hard second phase of a sufficient amount is to be transformingly formed in cooling thereafter.

When the annealing temperature is below (Ac1+Ac3)/2, cementite is not sufficiently dissolved and remains in a coarse state, and the ductility deteriorates. On the other hand, when the annealing temperature exceeds Ac3, entire cementite is dissolved which results in that the hardness of tempered martensite and the like increases and the ductility deteriorates.

Also, when the annealing holding time exceeds 3,600 s, the productivity extremely deteriorates which is not preferable. Preferable lower limit of the annealing holding time is 60 s. By extending the heating time, the strain within ferrite can be further removed.

<Slow Cooling with First Cooling Rate of 1° C./s or more and less than 50° C./s to First Cooling Completion Temperature of 730° C. or below and 500° C. or above>

The reason for setting the above condition is that, by making the size of ferrite nucleated during cooling a size generally same to that of ferrite formed in the dual-phase range described above and forming the ferrite microstructure having 20-50% in terms of the area ratio combining them, the elongation is made capable of being improved while securing stretch flange formability.

At the temperature below 500° C. or with the cooling rate of less than 1° C./s, ferrite is formed excessively, and the elongation and stretch flange formability cannot be secured.

<Rapid Cooling with Second Cooling Rate of 50° C./s or more to Second Cooling Completion Temperature of Ms Point or below>

The reason for setting the above condition is that, ferrite is to be suppressed from being formed from austenite during cooling, and the hard second phase is to be obtained.

When rapid cooling is finished at a temperature higher than Ms point or the cooling rate becomes less than 50° C./s, bainite is formed excessively, and the strength of the steel sheet cannot be secured.

[Tempering Condition]

With respect to the tempering condition, it is preferable to execute heating from the temperature after annealing cooling described above to the tempering temperature: 300-500° C., to be held within the temperature range of 300° C.-tempering temperature for the tempering holding time: 60-1,200 s, and to execute cooling thereafter.

The reason for setting the above condition is that, while the solid solution C concentrated into ferrite in annealing described above is made to remain in ferrite as it is even after tempering is effected and the hardness of ferrite is increased, C is to be made to precipitate as cementite further in tempering from the hard second phase where C content has dropped as a reaction of concentration of the solid solution C into ferrite in annealing described above, the fine cementite grains are to be coarsened, and the hardness of the hard second phase is to be lowered.

When the tempering temperature is below 300° C. or the tempering time is less than 60 s, softening of the hard second phase becomes insufficient. On the other hand, when the tempering temperature exceeds 500° C., the hard second phase is softened excessively and the strength cannot be secured, or cementite is coarsened excessively and stretch flange formability deteriorates. Also, when the tempering time exceeds 1,200 s, the productivity lowers which is not preferable.

Preferable range of the tempering temperature is 320-480° C., and preferable range of the tempering holding time is 120-600 s.

EXAMPLE

Steel having various compositions was smelted as shown in Tables 1 below, and an ingot with 120 mm thickness was manufactured. The ingot was hot-rolled to 25 mm thickness, was thereafter hot-rolled again to 3.2 mm thickness under various manufacturing conditions shown in Tables 2-4 below, was pickled, was thereafter cold-rolled further to 1.6 mm thickness, and was thereafter subjected to a heat treatment (refer to the heat treatment pattern shown in FIG. 1).

Also, Ac1 and Ac3 in Table 1 were obtained using the formula 1 and the formula 2 below (refer to "The Physical Metallurgy of Steels", Leslie, Translation Supervisor: KOHDA Shigeyasu, Maruzen Company, Limited (1985), p. 273).

$$Ac1\ (°\ C.)=723+29.1[Si]-10.7[Mn]+16.9[Cr]-16.9[Ni] \quad \text{Formula 1}$$

$$Ac3\ (°\ C.)=910-203\sqrt{[C]}+44.7[Si]+31.5[Mo]-15.2[Ni] \quad \text{Formula 2}$$

where [ ] represents the content (mass %) of each element.

TABLE 1

| | Chemical composition (mass %) [Remainder: Fe and inevitable impurities] | | | | | | | | Ac1 | Ac3 | (Ac1 + Ac3)/2 |
|---|---|---|---|---|---|---|---|---|---|---|---|
| Steel kind | C | Si | Mn | P | S | Al | N | Others | (° C.) | (° C.) | (° C.) |
| A-1 | 0.17 | 1.19 | 1.81 | 0.001 | 0.003 | 0.032 | 0.0045 | Mo: 0.15 | 738 | 884 | 811 |
| A-2 | 0.13 | 1.27 | 2.18 | 0.003 | 0.001 | 0.043 | 0.0045 | Mo: 0.17 | 737 | 899 | 818 |
| B-1 | 0.16 | 1.23 | 2.12 | 0.003 | 0.004 | 0.043 | 0.0028 | Ca: 0.0013 | 737 | 909 | 823 |

TABLE 1-continued

| Steel kind | Chemical composition (mass %) [Remainder: Fe and inevitable impurities] C | Si | Mn | P | S | Al | N | Others | Ac1 (° C.) | Ac3 (° C.) | (Ac1 + Ac3)/2 (° C.) |
|---|---|---|---|---|---|---|---|---|---|---|---|
| B-2 | 0.16 | 1.92 | 1.87 | 0.001 | 0.002 | 0.047 | 0.0041 | Ca: 0.0006 | 742 | 896 | 819 |
| C-1 | 0.17 | 1.23 | 1.83 | 0.003 | 0.001 | 0.037 | 0.0033 | Cu: 0.09, Ca: 0.0007 | 744 | 885 | 814 |
| C-2 | 0.13 | 1.28 | 0.67 | 0.002 | 0.001 | 0.046 | 0.0042 | Cu: 0.07, Ca: 0.0003 | 724 | 893 | 809 |
| D-1 | 0.08 | 1.26 | 1.80 | 0.001 | 0.001 | 0.031 | 0.0039 | Li: 0.0005 | 748 | 895 | 822 |
| D-2 | 0.13 | 1.32 | 1.19 | 0.003 | 0.002 | 0.039 | 0.0027 | Li: 0.0004 | 742 | 886 | 814 |
| E-1 | 0.17 | 1.31 | 1.50 | 0.002 | 0.002 | 0.035 | 0.0044 | Ni: 0.11, REM: 0.0005 | 740 | 884 | 812 |
| E-2 | 0.12 | 1.20 | 1.97 | 0.003 | 0.005 | 0.038 | 0.0036 | Ni: 0.08, REM: 0.0010 | 746 | 885 | 816 |
| F-1 | 0.15 | 1.42 | 1.92 | 0.001 | 0.002 | 0.046 | 0.0048 | Ca: 0.0009 | 742 | 868 | 805 |
| F-2 | 0.14 | 1.16 | 2.09 | 0.002 | 0.009 | 0.037 | 0.0041 | Ca: 0.0005 | 737 | 894 | 816 |
| G-1 | 0.15 | 1.22 | 2.07 | 0.002 | 0.004 | 0.043 | 0.0029 | Cr: 0.29 | 746 | 885 | 815 |
| G-2 | 0.17 | 1.35 | 1.52 | 0.003 | 0.004 | 0.042 | 0.0042 | Cr: 0.18 | 737 | 884 | 811 |
| H-1 | 0.22 | 1.19 | 2.87 | 0.002 | 0.001 | 0.040 | 0.0030 | — | 739 | 883 | 811 |
| H-2 | 0.13 | 1.28 | 1.57 | 0.002 | 0.005 | 0.044 | 0.0054 | — | 773 | 924 | 848 |
| I-1 | 0.18 | 1.37 | 1.86 | 0.009 | 0.002 | 0.032 | 0.0054 | Ca: 0.0006, Li: 0.0009 | 735 | 882 | 809 |
| I-2 | 0.15 | 1.17 | 2.13 | 0.001 | 0.005 | 0.037 | 0.0032 | Cr: 0.6, Ca: 0.0009, Li: 0.0014 | 750 | 888 | 819 |
| J-1 | 0.16 | 1.22 | 1.84 | 0.001 | 0.003 | 0.041 | 0.0052 | — | 746 | 864 | 805 |
| J-2 | 0.18 | 2.24 | 1.61 | 0.003 | 0.002 | 0.035 | 0.0032 | — | 752 | 889 | 820 |
| K-1 | 0.16 | 1.20 | 3.19 | 0.002 | 0.001 | 0.039 | 0.0032 | Mg: 0.0002 | 760 | 912 | 836 |
| K-2 | 0.18 | 1.43 | 1.48 | 0.016 | 0.005 | 0.044 | 0.0039 | Mg: 0.0004 | 746 | 884 | 815 |
| L-1 | 0.28 | 1.37 | 1.37 | 0.002 | 0.004 | 0.036 | 0.0049 | — | 745 | 881 | 813 |
| L-2 | 0.14 | 1.29 | 1.54 | 0.001 | 0.004 | 0.034 | 0.0043 | — | 739 | 884 | 812 |
| M-1 | 0.17 | 1.40 | 1.60 | 0.001 | 0.004 | 0.036 | 0.0043 | Cr: 0.12, Mo: 0.06 | 743 | 901 | 822 |
| M-2 | 0.14 | 1.31 | 1.61 | 0.003 | 0.008 | 0.039 | 0.0048 | Cr: 0.08, Mo: 0.09 | 739 | 895 | 817 |
| N-1 | 0.17 | 1.30 | 2.14 | 0.025 | 0.001 | 0.033 | 0.0046 | Ni: 0.45 | 731 | 878 | 804 |
| N-2 | 0.12 | 0.56 | 1.60 | 0.003 | 0.005 | 0.046 | 0.0037 | Ni: 0.35 | 717 | 859 | 788 |
| O-1 | 0.12 | 1.26 | 1.84 | 0.003 | 0.004 | 0.037 | 0.0041 | Ca: 0.0012 | 729 | 896 | 812 |
| O-2 | 0.15 | 1.27 | 1.80 | 0.002 | 0.004 | 0.032 | 0.0041 | Ca: 0.0005 | 743 | 888 | 816 |
| P-1 | 0.13 | 1.29 | 1.42 | 0.002 | 0.001 | 0.044 | 0.0049 | — | 741 | 894 | 818 |
| P-2 | 0.14 | 1.44 | 2.15 | 0.005 | 0.003 | 0.031 | 0.0040 | — | 742 | 898 | 820 |
| Q-1 | 0.16 | 1.26 | 1.42 | 0.002 | 0.003 | 0.039 | 0.0043 | Cu: 0.12, Ni: 0.08 | 743 | 884 | 814 |
| Q-2 | 0.19 | 1.33 | 1.57 | 0.003 | 0.002 | 0.047 | 0.0049 | Cu: 0.14, Ni: 0.12 | 743 | 879 | 811 |

(Underline: out of range of invention of present application, –: less than detection limit)

TABLE 2

| Manufacturing No. | Steel kind | Hot rolling condition Coiling temperature (° C.) | Cold rolling condition Cold rolling ratio (%) | Annealing condition First heating rate HR1 (° C./s) | Second heating rate HR2 (° C./s) | HR2/HR1 (—) | Annealing temperature (° C.) | Annealing holding time (s) | Slow cooling rate (° C./s) | Slow cooling completion temperature (° C.) | Rapid cooling rate (° C./s) | Rapid cooling completion temperature (° C.) | Tempering condition Tempering temperature (° C.) | Tempering holding time (s) |
|---|---|---|---|---|---|---|---|---|---|---|---|---|---|---|
| 1 | A-1 A-2 | 650 | 60 | 4.8 | 2.2 | 0.46 | 860 | 120 | 10 | 650 | 60 | 60 | 450 | 300 |
| 2 | B-1 B-2 | 620 | 60 | 4.8 | 2.2 | 0.46 | 850 | 120 | 10 | 650 | 60 | 60 | 450 | 300 |
| 3 | C-1 C-2 | 650 | 60 | 4.8 | 2.2 | 0.46 | 850 | 120 | 10 | 650 | 60 | 60 | 450 | 300 |
| 4 | D-1 D-2 | 650 | 60 | 4.8 | 2.2 | 0.46 | 850 | 120 | 10 | 650 | 60 | 60 | 450 | 300 |
| 5 | E-1 E-2 | 650 | 65 | 4.8 | 2.2 | 0.46 | 850 | 120 | 10 | 650 | 60 | 60 | 450 | 300 |
| 6 | F-1 F-2 | 650 | 60 | 4.8 | 2.2 | 0.46 | 850 | 120 | 10 | 600 | 60 | 60 | 450 | 300 |
| 7 | G-1 G-2 | 650 | 60 | 4.8 | 2.2 | 0.46 | 850 | 120 | 10 | 650 | 60 | 60 | 480 | 300 |
| 8 | H-1 H-2 | 450 | 60 | 4.8 | 2.2 | 0.46 | 850 | 120 | 10 | 650 | 60 | 60 | 450 | 300 |
| 9 | H-1 H-2 | 600 | 55 | 4.8 | 2.2 | 0.46 | 850 | 120 | 10 | 650 | 60 | 60 | 450 | 300 |
| 10 | H-1 H-2 | 650 | 30 | 4.8 | 2.2 | 0.46 | 850 | 120 | 10 | 650 | 60 | 60 | 450 | 300 |

(Underline: out of range of invention of present application)

TABLE 3

(Continued from Table 2)

| Manufacturing No. | Steel kind | Hot rolling condition Coiling temperature (° C.) | Cold rolling condition Cold rolling ratio (%) | Annealing condition First heating rate HR1 (° C./s) | Second heating rate HR2 (° C./s) | HR2/HR1 (—) | Annealing temperature (° C.) | Annealing holding time (s) | Slow cooling rate (° C./s) | Slow cooling completion temperature (° C.) | Rapid cooling rate (° C./s) | Rapid cooling completion temperature (° C.) | Tempering condition Tempering temperature (° C.) | Tempering holding time (s) |
|---|---|---|---|---|---|---|---|---|---|---|---|---|---|---|
| 11 | H-1<br>H-2 | 650 | 60 | 7.5 | 2.2 | 0.29 | 850 | 120 | 10 | 650 | 60 | 60 | 450 | 300 |
| 12 | H-1<br>H-2 | 650 | 60 | 3.6 | 1.3 | 0.36 | 850 | 120 | 10 | 650 | 60 | 60 | 450 | 300 |
| 13 | H-1<br>H-2 | 650 | 30 | 4.8 | 4.8 | 1.00 | 850 | 120 | 10 | 650 | 60 | 60 | 450 | 300 |
| 14 | H-1<br>H-2 | 650 | 60 | 4.8 | 2.2 | 0.46 | 850 | 120 | 10 | 650 | 60 | 60 | 400 | 200 |
| 15 | H-1<br>H-2 | 650 | 60 | 4.8 | 2.2 | 0.46 | 825 | 120 | 10 | 650 | 60 | 60 | 450 | 300 |
| 16 | H-1<br>H-2 | 650 | 60 | 4.8 | 2.2 | 0.46 | 850 | 120 | 0.8 | 600 | 60 | 60 | 450 | 300 |
| 17 | H-1<br>H-2 | 650 | 60 | 4.8 | 2.2 | 0.46 | 850 | 120 | 30 | 650 | 60 | 60 | 450 | 300 |
| 18 | H-1<br>H-2 | 650 | 60 | 4.8 | 2.2 | 0.46 | 850 | 120 | 10 | 480 | 60 | 60 | 450 | 300 |
| 19 | H-1<br>H-2 | 650 | 60 | 4.8 | 2.2 | 0.46 | 850 | 120 | 10 | 650 | 60 | 300 | 450 | 300 |
| 20 | H-1<br>H-2 | 650 | 60 | 4.8 | 2.2 | 0.46 | 850 | 120 | 10 | 650 | 60 | 10 | 350 | 300 |

(Underline: out of range of invention of present application)

TABLE 4

(Continued from Table 3)

| Manufacturing No. | Steel kind | Hot rolling condition Coiling temperature (° C.) | Cold rolling condition Cold rolling ratio (%) | Annealing condition First heating rate HR1 (° C./s) | Second heating rate HR2 (° C./s) | HR2/HR1 (—) | Annealing temperature (° C.) | Annealing holding time (s) | Slow cooling rate (° C./s) | Slow cooling completion temperature (° C.) | Rapid cooling rate (° C./s) | Rapid cooling completion temperature (° C.) | Tempering condition Tempering temperature (° C.) | Tempering holding time (s) |
|---|---|---|---|---|---|---|---|---|---|---|---|---|---|---|
| 21 | H-1<br>H-2 | 650 | 60 | 4.8 | 2.2 | 0.46 | 850 | 120 | 10 | 650 | 60 | 60 | 600 | 650 |
| 22 | I-1<br>I-2 | 650 | 60 | 4.2 | 1.8 | 0.43 | 850 | 120 | 10 | 650 | 60 | 60 | 450 | 650 |
| 23 | J-1<br>J-2 | 650 | 60 | 4.8 | 2.2 | 0.46 | 850 | 180 | 10 | 650 | 60 | 60 | 450 | 650 |
| 24 | K-1<br>K-2 | 650 | 60 | 4.8 | 2.2 | 0.46 | 850 | 120 | 10 | 650 | 60 | 60 | 425 | 650 |
| 25 | L-1<br>L-2 | 650 | 65 | 4.8 | 2.2 | 0.46 | 825 | 120 | 10 | 650 | 60 | 60 | 450 | 650 |
| 26 | M-1<br>M-2 | 650 | 60 | 4.8 | 2.2 | 0.46 | 850 | 120 | 10 | 650 | 100 | 60 | 425 | 625 |
| 27 | N-1<br>N-2 | 650 | 60 | 4.2 | 1.2 | 0.29 | 825 | 100 | 8 | 650 | 60 | 30 | 400 | 650 |
| 28 | O-1<br>O-2 | 650 | 55 | 4.8 | 2.2 | 0.46 | 850 | 120 | 10 | 650 | 60 | 60 | 480 | 650 |
| 29 | P-1<br>P-2 | 550 | 60 | 4.8 | 2.2 | 0.46 | 870 | 120 | 10 | 600 | 60 | 60 | 450 | 550 |
| 30 | Q-1<br>Q-2 | 650 | 60 | 4.8 | 1.9 | 0.42 | 825 | 120 | 10 | 625 | 70 | 60 | 450 | 650 |

(Underline: out of range of invention of present application)

With respect to each steel sheet after heat treatment, the area ratio of each phase, the size of the ferrite grain and the area percent of the ferrite grain of a specific size, as well as the size of the cementite grain and the existence density of the cementite grain of a specific size were measured by the measuring method described in the section of [Description of Embodiments] described above.

Also, with respect to each steel sheet after the heat treatment described above, the property of each steel sheet was evaluated by measuring the tensile strength TS, elongation EL and stretch flange formability λ, and the stability of the property of each steel sheet was evaluated from the degree of the variation in the property caused by the change of the chemical composition.

More specifically, with respect to the property of the steel sheet after the heat treatment, those satisfying all of TS≥980 MPa, EL≥13%, λ≥40% were evaluated to have passed (○), and those other than them were evaluated to have failed (X).

Also, with respect to the stability of the property of the steel sheet after heat treatment, for each of the specimen of two steel kinds (A-1 and A-2 for example) changing a specific chemical composition, the manufacturing test was executed with the same manufacturing condition (manufacturing No. 1 for example), those satisfying all of ΔTS≤150 MPa, ΔEL≤2%, and Δλ≤15%, ΔTS, ΔEL, and Δλ being the change width of TS, EL, and λ respectively, were evaluated to have passed (○), and those other than thereof were evaluated to have failed (X).

Also, with respect to the tensile strength TS and the elongation EL, No. 5 specimen described in JIS Z 2201 was manufactured so that the longitudinal axis thereof became the direction orthogonal to the rolling direction, and measurement was executed according to JIS Z 2241. Further, with respect to the stretch flange formability λ, the hole expanding test was executed according to the Japan Iron and Steel Federation Standards JFST 1001 to measure the hole expansion ratio, and the result was made the stretch flange formability.

The measurement results are shown in Tables 5-7.

From these Tables, manufacturing Nos. 1, 2, 5-7, 9, 12, 14, 17, 20, 22, 26-30 are the inventive examples satisfying all requirements of the invention of the present application. It is known that, in any of the inventive examples, a homogeneous cold-rolled steel sheet not only excellent in the absolute value of the mechanical property but also suppressing the variation in the mechanical property which was caused by the fluctuation of the chemical composition was obtained.

On the other hand, each of the comparative examples not satisfying any of the requirements of the invention of the present application has such unsatisfactory points as described below.

In manufacturing No. 3, with the steel kind C-2, because Mn is excessively small, the recrystallization ferrite grains are liable to be coarsened during heating, the percentage of the ferrite grains of 10-25 μm is insufficient, and, as a result, TS does not attain the acceptance criteria. Further, in spite that the steel sheet is manufactured with the manufacturing condition same to that in the steel kind C-1 in which Mn is within the adequate range, ΔEL does not satisfy the acceptance criteria, either.

In manufacturing No. 4, with the steel kind D-1, because C is excessively small, the area ratio of ferrite becomes excessive, formation of cementite is insufficient, and, as a result, TS does not attain the acceptance criteria. Further, in spite that the steel sheet is manufactured with the manufacturing condition same to that in the steel kind D-2 in which C is within the adequate range, ΔEL does not satisfy the acceptance criteria, either.

In manufacturing No. 8, because the coiling temperature is excessively low, cementite is not formed sufficiently, and, as a result, even when the steel sheet is manufactured with the same manufacturing condition between the steel kinds H-1 and H-2 whose chemical compositions are different from each other, ΔTS and ΔEL do not satisfy the acceptance criteria.

In manufacturing No. 10, because the cold rolling ratio is excessively low, the grain size of ferrite is not regulated sufficiently, and, as a result, even when the steel sheet is manufactured with the same manufacturing condition between the steel kinds H-1 and H-2 whose chemical compositions are different from each other, ΔEL does not satisfy the acceptance criteria.

In manufacturing No. 11, because the first heating rate in annealing is excessively high, cementite is not formed sufficiently, and, as a result, even when the steel sheet is manufactured with the same manufacturing condition between the steel kinds H-1 and H-2 whose chemical compositions are different from each other, ΔTS does not satisfy the acceptance criteria.

In manufacturing No. 13, because the cold rolling ratio is low and the ratio of the second heating rate/the first heating rate in annealing is excessively high, the grain size of ferrite is not regulated sufficiently, cementite is excessively formed occasionally, and, as a result, even when the steel sheet is manufactured with the same manufacturing condition between the steel kinds H-1 and H-2 whose chemical compositions are different from each other, Δλ does not satisfy the acceptance criteria.

In manufacturing No. 15, because the annealing temperature is excessively low, the grain size of ferrite is not regulated sufficiently, cementite is formed excessively, and, as a result, even when the steel sheet is manufactured with the same manufacturing condition between the steel kinds H-1 and H-2 whose chemical compositions are different from each other, Δλ does not satisfy the acceptance criteria.

In manufacturing No. 16, because the slow cooling rate is excessively low, the area ratio of ferrite occasionally becomes insufficient, and, as a result, even when the steel sheet is manufactured with the same manufacturing condition between the steel kinds H-1 and H-2 whose chemical compositions are different from each other, Δλ does not satisfy the acceptance criteria.

In manufacturing No. 18, because the slow cooling completion temperature is excessively low, ferrite is formed excessively, the area ratio of ferrite becomes excessive, and, as a result, in both of the steel kinds H-1 and H-2 whose chemical compositions are different from each other, TS and λ do not attain the acceptance criteria.

In manufacturing No. 19, because the rapid cooling completion temperature is excessively high, other microstructure (mainly retained austenite) is formed, and, as a result, in both of the steel kinds H-1 and H-2 whose chemical compositions are different from each other, λ does not attain the acceptance criteria.

In manufacturing No. 21, because the tempering temperature is excessively high, the hard second phase is excessively softened, and, as a result, in both of the steel kinds H-1 and H-2 whose chemical compositions are different from each other, TS does not attain the acceptance criteria.

In manufacturing No. 23, because Si is excessive in the steel kind J-2, cementite is not formed sufficiently, and, as a result, EL and λ do not attain the acceptance criteria. Further, in spite that the steel sheet is manufactured with the manufacturing condition same to that of the steel kind J-1 in which Si is within the adequate range, ΔEL does not satisfy the acceptance criteria, either.

In manufacturing No. 24, because Mn is excessive in the steel kind K-1, cementite is formed excessively, and, as a result, EL and λ do not attain the acceptance criteria. Further, in spite that the steel sheet is manufactured with the manufacturing condition same to that of the steel kind K-2 in which Mn is within the adequate range, ΔEL does not satisfy the acceptance criteria, either.

In manufacturing No. 25, because C is excessive in the steel kind L-1, the area ratio of cementite is insufficient, and, as a result, EL does not attain the acceptance criteria. Further, in spite that the steel sheet is manufactured with the manufacturing condition same to that of the steel kind L-2 in which C is within the adequate range, ΔTS, ΔEL, and Δλ also do not satisfy the acceptance criteria.

TABLE 5

| | | Microstructure | | | | | | | | | | | | |
|---|---|---|---|---|---|---|---|---|---|---|---|---|---|---|
| | | Area ratio (%) | | | Rate of | Density of θ of | Mechanical Properties | | | | Variation in mechanical properties | | | |
| Manufacturing No. | Steel kind | α | Hard Second phase | Other micro-structure | α of 10-25 μm (%) | 0.3 μm or more (piece/μm$^2$) | TS (MPa) | EL (%) | λ (%) | Evaluation | ΔTS (MPa) | ΔEL (%) | Δλ (%) | Evaluation |
| 1 | A-1 | 38 | 62 | 0 | 88 | 0.42 | 1073 | 13.8 | 53.6 | ○ | 44 | 1.3 | 2.4 | ○ |
| | A-2 | 38 | 62 | 0 | 84 | 0.50 | 1029 | 15.1 | 51.2 | ○ | | | | |
| 2 | B-1 | 35 | 65 | 0 | 92 | 0.53 | 1061 | 15.3 | 51.4 | ○ | 6 | 0.5 | 2.2 | ○ |
| | B-2 | 32 | 68 | 0 | 94 | 0.34 | 1067 | 15.8 | 49.2 | ○ | | | | |
| 3 | C-1 | 36 | 64 | 0 | 89 | 0.40 | 1055 | 14.5 | 50.8 | ○ | 103 | 4.0 | 7.7 | X |
| | C-2 | 43 | 57 | 0 | 63 | 0.11 | 952 | 18.5 | 43.1 | X | | | | |
| 4 | D-1 | 78 | 22 | 0 | 72 | 0.07 | 889 | 20.5 | 66.3 | X | 123 | 5.3 | 9.5 | X |
| | D-2 | 44 | 56 | 0 | 90 | 0.48 | 1012 | 15.2 | 56.8 | ○ | | | | |
| 5 | E-1 | 36 | 64 | 0 | 92 | 0.44 | 1081 | 14.5 | 57.2 | ○ | 13 | 0.3 | 1.1 | ○ |
| | E-2 | 34 | 66 | 0 | 93 | 0.42 | 1068 | 14.2 | 56.1 | ○ | | | | |
| 6 | F-1 | 40 | 60 | 0 | 85 | 0.55 | 1038 | 15.6 | 49.6 | ○ | 6 | 0.4 | 5.7 | ○ |
| | F-2 | 39 | 61 | 0 | 86 | 0.58 | 1044 | 16.0 | 55.3 | ○ | | | | |
| 7 | G-1 | 38 | 62 | 0 | 88 | 0.47 | 1115 | 13.5 | 48.9 | ○ | 34 | 1.0 | 6.6 | ○ |
| | G-2 | 38 | 62 | 0 | 86 | 0.53 | 1081 | 14.5 | 55.5 | ○ | | | | |
| 8 | H-1 | 36 | 64 | 0 | 91 | 0.12 | 1184 | 13.5 | 40.2 | ○ | 162 | 1.0 | 18.7 | X |
| | H-2 | 44 | 56 | 0 | 87 | 0.11 | 1022 | 14.5 | 58.9 | ○ | | | | |
| 9 | H-1 | 38 | 62 | 0 | 81 | 0.53 | 1088 | 14.2 | 48.9 | ○ | 53 | 0.9 | 5.4 | ○ |
| | H-2 | 44 | 56 | 0 | 83 | 0.38 | 1035 | 15.1 | 54.3 | ○ | | | | |
| 10 | H-1 | 39 | 61 | 0 | 78 | 0.44 | 1040 | 13.1 | 57.5 | ○ | 2 | 2.5 | 2.8 | X |
| | H-2 | 48 | 52 | 0 | 69 | 0.32 | 1042 | 15.6 | 40.3 | ○ | | | | |

(Underline: out of range of invention of present application, α: ferrite, other microstructure: retained austenite + martensite, θ: cementite)

TABLE 6

(continued from Table 5)

| | | Microstructure | | | | | | | | | | | | |
|---|---|---|---|---|---|---|---|---|---|---|---|---|---|---|
| | | Area ratio (%) | | | Rate of | Density of θ of | Mechanical Properties | | | | Variation in mechanical properties | | | |
| Manufacturing No. | Steel kind | α | Hard Second phase | Other micro-structure | α of 10-25 μm (%) | 0.3 μm or more (piece/μm$^2$) | TS (MPa) | EL (%) | λ (%) | Evaluation | ΔTS (MPa) | ΔEL (%) | Δλ (%) | Evaluation |
| 11 | H-1 | 25 | 75 | 0 | 87 | 0.04 | 1218 | 13.0 | 53.9 | ○ | 159 | 1.8 | 12.5 | X |
| | H-2 | 37 | 63 | 0 | 85 | 0.02 | 1059 | 14.8 | 66.4 | ○ | | | | |
| 12 | H-1 | 42 | 58 | 0 | 85 | 0.89 | 1058 | 15.8 | 62.8 | ○ | 36 | 0.9 | 4.4 | ○ |
| | H-2 | 46 | 54 | 0 | 85 | 0.68 | 1022 | 14.9 | 58.4 | ○ | | | | |
| 13 | H-1 | 46 | 54 | 0 | 75 | 1.12 | 998 | 15.1 | 20.4 | X | 21 | 0.2 | 29.3 | X |
| | H-2 | 48 | 52 | 0 | 66 | 0.70 | 1019 | 15.3 | 49.7 | ○ | | | | |
| 14 | H-1 | 39 | 61 | 0 | 85 | 0.55 | 1109 | 14.2 | 52.8 | ○ | 46 | 0.2 | 1.1 | ○ |
| | H-2 | 43 | 57 | 0 | 83 | 0.40 | 1063 | 14.0 | 53.9 | ○ | | | | |
| 15 | H-1 | 40 | 60 | 0 | 91 | 1.03 | 1001 | 14.7 | 22.9 | X | 46 | 1.9 | 18.6 | X |
| | H-2 | 43 | 57 | 0 | 68 | 0.65 | 1047 | 12.8 | 41.5 | X | | | | |
| 16 | H-1 | 42 | 58 | 0 | 88 | 0.63 | 1032 | 14.4 | 65.1 | ○ | 88 | 4.4 | 26.2 | X |
| | H-2 | 54 | 46 | 0 | 92 | 0.58 | 944 | 18.8 | 38.9 | X | | | | |
| 17 | H-1 | 30 | 70 | 0 | 90 | 0.57 | 1078 | 14.2 | 52.8 | ○ | 65 | 1.3 | 5.6 | ○ |
| | H-2 | 34 | 66 | 0 | 91 | 0.55 | 1013 | 15.5 | 58.4 | ○ | | | | |
| 18 | H-1 | 51 | 49 | 0 | 87 | 0.63 | 978 | 16.6 | 30.8 | X | 46 | 0.7 | 5.3 | ○ |
| | H-2 | 55 | 45 | 0 | 86 | 0.60 | 932 | 15.9 | 36.1 | X | | | | |
| 19 | H-1 | 42 | 46 | 12 | 84 | 0.35 | 1101 | 18.5 | 18.2 | X | 45 | 1.4 | 4.3 | ○ |
| | H-2 | 45 | 49 | 6 | 81 | 0.32 | 1056 | 19.9 | 22.5 | X | | | | |
| 20 | H-1 | 39 | 61 | 0 | 85 | 0.49 | 1096 | 13.4 | 42.1 | ○ | 41 | 0.5 | 3.8 | ○ |
| | H-2 | 43 | 57 | 0 | 85 | 0.39 | 1055 | 13.9 | 45.9 | ○ | | | | |

(Underline: out of range of invention of present application, α: ferrite, other microstructure: retained austenite + martensite, θ: cementite)

TABLE 7

(Continued from Table 6)

| Manufacturing No. | Steel kind | Microstructure: Area ratio (%) α | Hard Second phase | Other micro-structure | Rate of α of 10-25 μm (%) | Density of θ of 0.3 μm or more (piece/μm²) | Mechanical Properties: TS (MPa) | EL (%) | λ (%) | Evaluation | Variation in mechanical properties: ΔTS (MPa) | ΔEL (%) | Δλ (%) | Evaluation |
|---|---|---|---|---|---|---|---|---|---|---|---|---|---|---|
| 21 | H-1 | 40 | 60 | 0 | 86 | 0.66 | 962 | 21.5 | 63.5 | X | 70 | 1.2 | 4.6 | ○ |
| | H-2 | 45 | 55 | 0 | 82 | 0.59 | 892 | 20.3 | 68.1 | X | | | | |
| 22 | I-1 | 38 | 62 | 0 | 90 | 0.43 | 1062 | 14.2 | 52.4 | ○ | 11 | 0.3 | 1.5 | ○ |
| | I-2 | 37 | 63 | 0 | 89 | 0.40 | 1051 | 14.5 | 53.9 | ○ | | | | |
| 23 | J-1 | 40 | 60 | 0 | 85 | 0.41 | 1070 | 13.7 | 49.5 | ○ | 41 | 3.2 | 6.3 | X |
| | J-2 | 29 | 71 | 0 | 82 | 0.12 | 1211 | 10.5 | 35.8 | X | | | | |
| 24 | K-1 | 40 | 60 | 0 | 86 | 1.21 | 1185 | 9.8 | 25.5 | X | 107 | 5.5 | 11.5 | X |
| | K-2 | 41 | 59 | 0 | 89 | 0.45 | 1078 | 15.3 | 47.0 | ○ | | | | |
| 25 | L-1 | 18 | 82 | 0 | 95 | 0.52 | 1236 | 11.5 | 70.5 | X | 152 | 2.4 | 21.3 | X |
| | L-2 | 34 | 66 | 0 | 90 | 0.49 | 1084 | 13.9 | 49.2 | ○ | | | | |
| 26 | M-1 | 39 | 61 | 0 | 85 | 0.38 | 1082 | 14.4 | 51.2 | ○ | 26 | 0.4 | 2.7 | ○ |
| | M-2 | 42 | 58 | 0 | 84 | 0.33 | 1056 | 14.8 | 53.9 | ○ | | | | |
| 27 | N-1 | 45 | 55 | 0 | 81 | 0.71 | 1089 | 14.5 | 41.2 | ○ | 62 | 1.1 | 3.7 | ○ |
| | N-2 | 48 | 52 | 0 | 81 | 0.56 | 1027 | 15.6 | 44.9 | ○ | | | | |
| 28 | O-1 | 36 | 64 | 0 | 82 | 0.67 | 1012 | 15.7 | 54.1 | ○ | 22 | 0.8 | 2.2 | ○ |
| | O-2 | 39 | 61 | 0 | 83 | 0.68 | 1034 | 14.9 | 56.3 | ○ | | | | |
| 29 | P-1 | 42 | 58 | 0 | 89 | 0.29 | 1053 | 15.1 | 45.2 | ○ | 9 | 0.4 | 1.3 | ○ |
| | P-2 | 41 | 59 | 0 | 90 | 0.24 | 1062 | 15.5 | 43.9 | ○ | | | | |
| 30 | Q-1 | 39 | 61 | 0 | 82 | 0.51 | 1040 | 14.4 | 57.4 | ○ | 12 | 0.4 | 5.1 | ○ |
| | Q-2 | 42 | 58 | 0 | 81 | 0.49 | 1052 | 14.8 | 52.3 | ○ | | | | |

(Underline: out of range of invention of present application, α: ferrite, other microstructure: retained austenite + martensite, θ: cementite)

Although the present invention has been described in detail referring to specific embodiments, it is obvious for a person with an ordinary skill in the art that various alterations and amendments can be effected without departing from the spirit and range of the present invention.

The present application is based on Japanese Patent Application (No. 2012-122033) applied on May 29, 2012, and the contents thereof are hereby incorporated by reference.

INDUSTRIAL APPLICABILITY

The high strength cold-rolled steel sheet of the present invention is useful as automobile components.

The invention claimed is:

1. A high strength cold-rolled steel sheet exhibiting little variation in strength and ductility, comprising:

C: 0.10-0.25%;
Si: 0.5-2.0%;
Mn: 1.0-3.0%;
P: 0.1% or less exclusive of 0%;
S: 0.01% or less exclusive of 0%;
Al: 0.01-0.05%; and
N: 0.01% or less exclusive of 0% respectively, with the remainder being iron and inevitable impurities, wherein % is mass % for each element with respect to the chemical composition;

wherein a microstructure of the high strength cold-rolled steel sheet comprises:

ferrite that is a soft first phase by 20-50% in terms of area ratio, with the remainder being tempered martensite and/or tempered bainite that is a hard second phase;

among all grains of the ferrite, a total area of grains that have an average grain size of 10-25 μm accounts for 80% or more of a total area of all grains of the ferrite;

the dispersion state of cementite grains that have an equivalent circle diameter of 0.3 μm or more present in all grains of the ferrite is more than 0.15 piece and 1.0 piece or less per 1 μm² of the ferrite; and wherein the tensile strength of the high strength cold-rolled steel sheet is 980 MPa or more.

2. The high strength cold-rolled steel sheet exhibiting little variation in strength and ductility according to claim 1, further comprising at least one group selected from the group consisting of (A)-(C):

(A) Cr: 0.01-1.0%;

(B) at least one element selected from the group consisting of Mo: 0.01-1.0%, Cu: 0.05-1.0%, and Ni: 0.05-1.0%; and (C) at least one element selected from the group consisting of Ca: 0.0001-0.01%, Mg: 0.0001-0.01%, Li: 0.0001-0.01%, and REM: 0.0001-0.01%.

3. The high strength cold-rolled steel sheet according to claim 1, comprising:

C: 0.12-0.19%;
Si: 0.56-1.44%;
Mn: 1.50-2.87%;
P: 0.001-0.005%;
S: 0.001%-0.008%;
Al: 0.031-0.047%; and
N: 0.0027-0.0054%.

4. The cold-rolled steel sheet according to claim 3, further comprising one or more of the following:

Mo: 0.15-0.17%;
Ca: 0.0003-0.0013%;
Li: 0.004-0.0014%;
Ni: 0.08-0.12%;
Cr: 0.08-0.6%;
Mg: 0.0002-0.0004%;
Cu: 0.12-0.14%; and
REM: 0.0005-0.0010%.

5. The high strength cold-rolled steel sheet according to claim 1, wherein the ferrite is a soft first phase by 32-46%;

grains of the ferrite having an average grain size of 10-25 μm account for 81-92% of a total area of all grains of the ferrite; and the cementite grains having an equivalent circle diameter of 0.3 μm or more present in all grains of the ferrite have a density of 0.34-0.89 piece/$\mu m^2$.

6. The high strength cold-rolled steel sheet according to claim 1, wherein the total area of the ferrite grains having an average grain size of 10-25 μm among all grains of the ferrite is 85% or more.

7. The high strength cold-rolled steel sheet according to claim 1, wherein the density of cementite grains having an equivalent circular diameter of 0.3 μm or more is 0.2-0.8 piece per 1 $\mu m^2$ of ferrite.

8. The high strength cold-rolled steel sheet according to claim 1, wherein C: 0.12-0.22%.

9. The high strength cold-rolled steel sheet according to claim 1, wherein Si: 1.0-1.5%.

10. The high strength cold-rolled steel sheet according to claim 1, wherein Mn: 1.4-2.2%.

11. The high strength cold-rolled steel sheet according to claim 1, wherein P: 0.03% or less exclusive of 0%.

12. The high strength cold-rolled steel sheet according to claim 1, wherein S: 0.006% or less exclusive of 0%.

13. A method for manufacturing the high strength cold-rolled steel sheet exhibiting little variation in strength and ductility of claim 1, comprising:

(1) hot-rolling with hot-rolling conditions:

finish-rolling temperature: Ar3 point or above coiling temperature: 600-750° C.;

(2) cold-rolling with cold-rolling conditions:

cold-rolling ratio: more than 50% and 80% or less;

(3) annealing with annealing conditions:

raising the temperature with a first heating rate of 0.5-5.0° C./s for the temperature range of room temperature to 600° C. and with a second heating rate of 1/2 or less of the first heating rate for the temperature range of 600° C. to the annealing temperature respectively, holding for an annealing holding time of 3,600 s or less at the annealing temperature of (Ac1+Ac3)/2−Ac3, thereafter slow cooling with a first cooling rate of 1° C./s or more and less than 50° C./s from the annealing temperature to a first cooling completion temperature of 730° C. or below and 500° C. or above, and thereafter rapid cooling with a second cooling rate of 50° C./s or more to a second cooling completion temperature of Ms point or below;

(4) tempering with tempering conditions:

tempering temperature: 300-500° C.

tempering holding time: 60-1,200 s within the temperature range of 300° C. to the tempering temperature.

14. The method of claim 13, wherein the cold rolling ratio is 50% to 70%.

15. The method of claim 13, wherein the first heating rate is 1.0-4.8° C./s.

16. The method according to claim 13, wherein the tempering temperature is 320-480° C.

17. The method according to claim 13, wherein the tempering holding time is 120-600 s.

* * * * *